United States Patent [19]

Jumer

[11] 4,127,459

[45] Nov. 28, 1978

[54] METHOD AND APPARATUS FOR INCREMENTAL ELECTRO-POLISHING

[76] Inventor: John F. Jumer, 16 W. 131 Timber Trails Dr., Oak Brook, Ill. 60521

[21] Appl. No.: 829,668

[22] Filed: Sep. 1, 1977

[51] Int. Cl.[2] ..... C25F 3/16; C25F 7/00

[52] U.S. Cl. ..... 204/129.5; 204/129.1; 204/206

[58] Field of Search ..... 204/129.1, 129.5, 206, 204/206-211, 224 R

[56] References Cited

U.S. PATENT DOCUMENTS

| | | | |
|---|---|---|---|
| 2,172,158 | 9/1939 | Brislee et al. | 204/129.5 |
| 2,861,937 | 11/1958 | Jumer | 204/212 |
| 3,857,764 | 12/1974 | Jumer | 204/26 |

*Primary Examiner*—F.C. Edmundson

*Attorney, Agent, or Firm*—Lockwood, Dewey, Alex & Cummings

[57] ABSTRACT

An apparatus and method for using same are disclosed for electro-polishing large flat or slightly curved surfaces on metal objects. The apparatus includes a shallow structure for electro-polishing flat horizontal surfaces, and a thin deep structure for electro-polishing vertical surfaces. The structure may be a tank having a liquid bath therein for immersing therein the metal object to be electro-polished. If the object is too large to be immersed in a separate tank, a temporary liquid bath containing structure is built on and around the object such that the surface to be electro-polished forms a boundary of the liquid containing structure. In either embodiment, a movable electrode (cathode) is depended from the sides of the structure and includes an active portion thereof which is positioned parallel to and spatially related from at least a portion of the surface to be electro-polished. In the method, the object is given a positive electric charge, the cathode (ungrounded) is given a negative charge, and as a portion of the surface is electro-polished, the cathode is moved, either continuously or discreetly, across the entire surface on which polishing is desired.

17 Claims, 9 Drawing Figures

FIG. 4
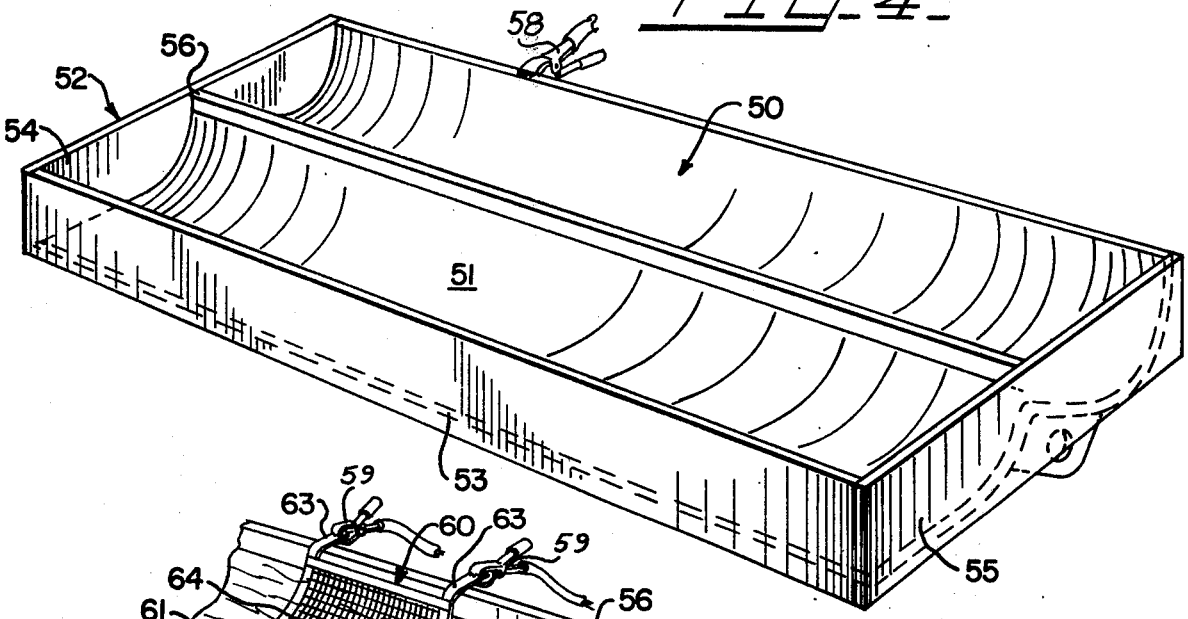
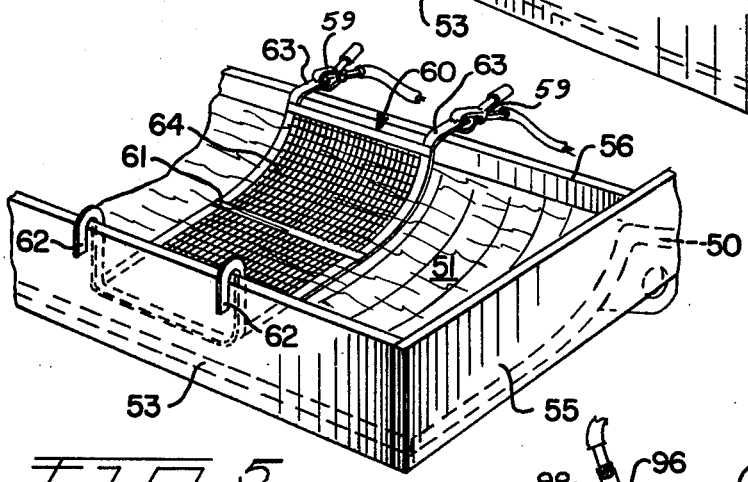
FIG. 5
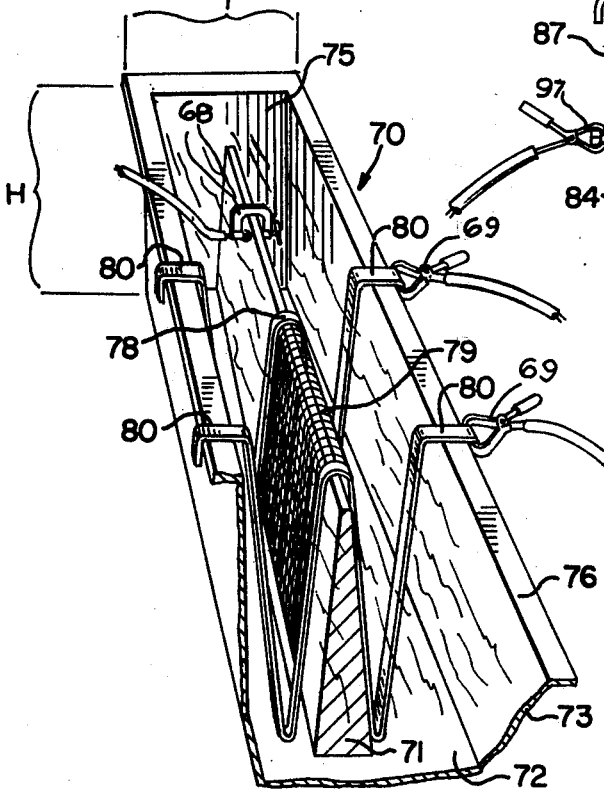
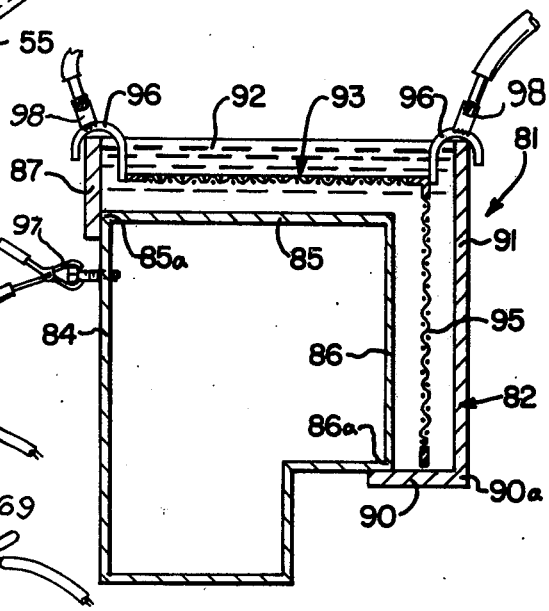
FIG. 7
FIG. 6

METHOD AND APPARATUS FOR INCREMENTAL ELECTRO-POLISHING

This invention relates to a practical apparatus and method of polishing large metal surfaces, and more particularly, this invention relates to electro-polishing large substantially flat and slightly curved or sloping metal surfaces.

In many industries wherein large amounts of small particles, fluid, or wet materials are processed, such as in the chemical, pharmaceutical, pulp and paper making, food processing, beverage and nuclear industries and the like, it is desirable that at least a portion of the machinery through which such materials are processed include passive surfaces thereon. In these situations, as well as others, it is also desirable to provide polished surfaces in order to promote high release properties, resistance to corrosion, facilitate cleaning, or for other reasons. While mechanical methods and polishing apparatus are often used, superior results can be obtained by electro-polishing such surfaces.

The art of chemical polishing and of electro-polishing of metal objects is well developed. For example, in my prior U.S. Pat. Nos. 2,861,937; 3,682,799; and 4,001,094; dated Nov. 25, 1968; Aug. 8, 1972; and Jan. 4, 1977; respectively, I have disclosed methods for electro-polishing the interior surface of large vessels. Also, in my U.S. Pat. No. 3,616,341, dated Oct. 26, 1971, I have disclosed in addition to a method for electro-polishing a large vessel, a method for electro-polishing large objects by initially immersing them in a polishing bath to a depth above the horizontal center line and then inverting the object and repeating the immersion so as to eliminate any line of demarcation between the polishing operations taking place during the differing immersions.

However, a need has developed for polishing flat or slightly curved surfaces on large metal objects while utilizing even less polishing bath than that disclosed in the "3,616,341 " patent referred to above. Further, a need has developed for polishing a surface or a plurality of surfaces on metal objects which are too large to be immersed or partially immersed in a polishing bath or tank. Large machinery, such as in the paper making industry, may include fabricated machine parts having large flat surfaces thereon. The operation of such machinery, or the quality of the product formed thereby, may be enhanced by polishing certain large flat or relatively flat surfaces on the machines. When such machine parts are made integral with a large machine, such as by welded construction, and cannot be removed, the immersion of a selected area of a part in a tank may be impossible.

It is therefore an object of the present invention, generally stated, to provide improved methods and means for electro-polishing large metal objects having at least one substantially flat or slightly curved surface thereon.

Another object of the present invention is the provision of electro-polishing large metal surfaces wherein a shallow or thin polishing bath may extend over or against the entire surface to be polished in order to provide an uninterrupted polishing action thereon.

A further object of the present invention is the provision of electro-polishing selected surfaces of metal objects which are so large that it is impractical to immerse them in any type of separate bath or tank apparatus.

The invention is directed to a method of electro-polishing a flat or slightly curved surface of a metal object wherein an electrolytic bath is positioned contiguously with the surface to be polished and the depth or width and volume of the bath is relatively small. The method includes the steps of: enclosing the surface to be electro-polished in an open top structure wherein the structure is capable of supporting either a shallow horizontal liquid bath or a thin vertical liquid bath depending upon the horizontal or vertical positioning, respectively, of the surface to be electro-polished; depending a removable electrode from the top of the structure wherein the electrode is positioned parallel to and in close spatial relation to the surface to be electro-polished; filling the structure with the liquid bath; charging the surface to be electro-polished with a positive electrical current; charging the electrode with a negative electrical current; and moving the electrode across the surface until same is electro-polished.

The invention is directed to an apparatus for electro-polishing the surface as defined in the previous paragraph. The apparatus includes an open top structure capable of surrounding the surface of the object to be electro-polished. A movable electrode is slidably positioned on the structure. and it includes an active portion engineered to be positioned in close parallel spatial relation to the surface to be electro-polished. Electric current producing means are utilized to provide a negative electrical charge to the electrode and to provide a positive electrical charge to the material to be electro-polished.

The features of the present invention, which are believed to be novel, are set forth with particularity in the appended claims. The invention may best be understood by reference to the following description of currently preferred embodiments taken in connection with the accompanying drawings wherein:

Figure 2A:
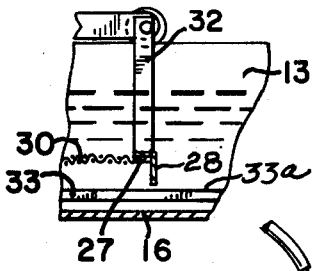
FIG. 2 is a cross sectional view taken along line 2—2 of FIG. 1, and further including a liquid bath positioned in the tank.

FIG. 2*a* is a partial cross-sectional view of a modification of the invention wherein a dielectric shield is depended from the trailing edge of the electrode.

Figure 1:
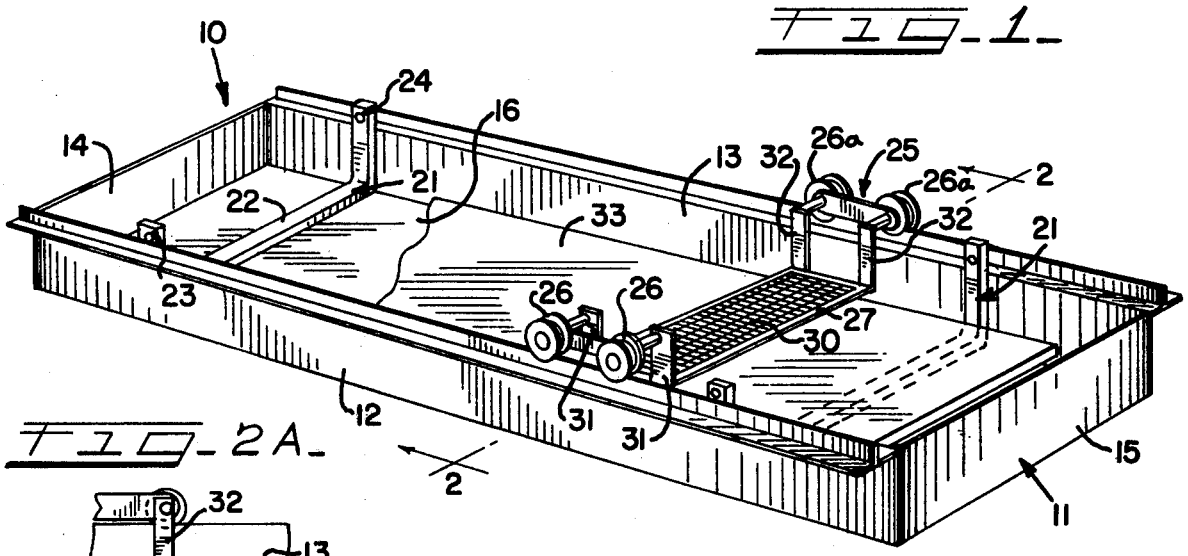
FIG. 1 is a perspective view, with portions cut away for clarity, of a shallow immersion tank having a metal sheet or plate inserted therein in a horizontal position suitable for electro-polishing the top surface thereof in accordance with the invention.
Figure 3A:
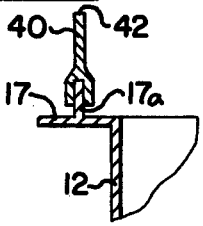
Figure 3:
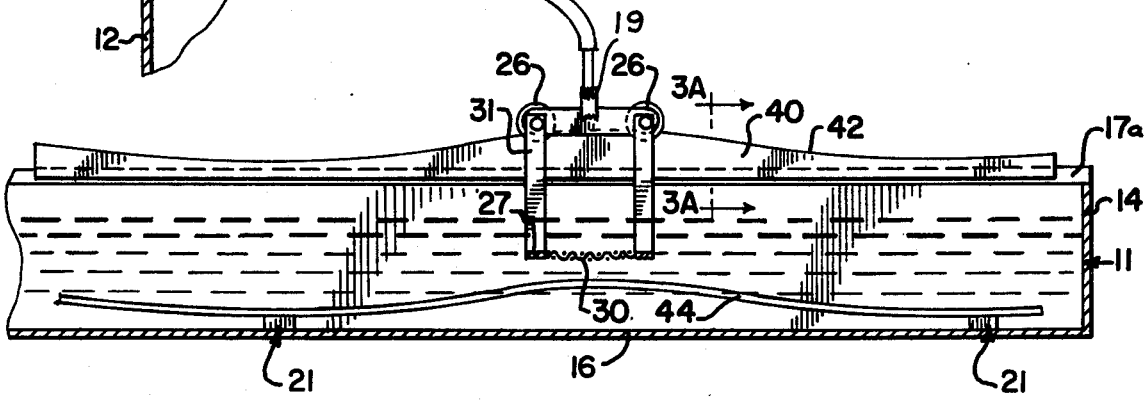

FIG. 3 is a fragmentary sectional view of a modification of the immersion tank shown in FIG. 1 wherein a pair of curved extensions have been added to the rails at the top of the immersion tank to allow the cathode to be moved in a fixed spatial relation over a curved metal sheet to be electro-polished therein.

FIG. 3*a* is a cross-sectional view taken along line 3*a*—3*a* of FIG. 3.

FIG. 4 is a perspective view of a large curved metal object having liquid bath containing sidewalls positioned therearound.

FIG. 5 is a partial perspective view of the apparatus shown in FIG. 4 wherein a movable cathode is supported on the fabricated sidewalls in a position suitable for electro-polishing a surface of the object.

FIG. 6 is a perspective view, partially cut away for clarity, of a modification of the invention defining a thin immersion tank including a wedge-shaped object positioned therein and having a wedge-shape cathode positioned in spaced relation thereover which is suitable for electro-polishing the object in accordance with the invention.

FIG. 7 is a sectional view of a large fabricated metal object having modification of the invention including liquid bath containing walls positioned therearound and a movable cathode positioned thereon for electro-polishing a vertical and a horizontal surface on the object in accordance with the invention.

Figure 2:
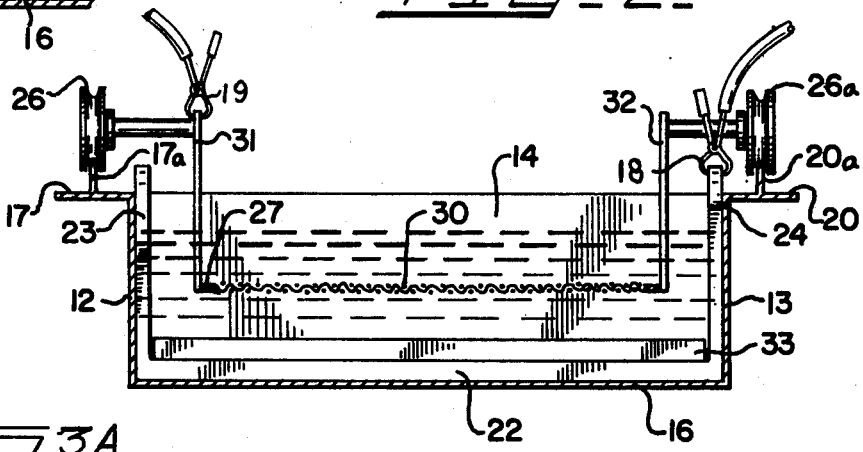

Referring to the embodiment shown in FIGS. 1 and 2, the electro-polishing apparatus, generally indicated at 10 and constructed in accordance with the invention, includes a tank 11 having a pair of elongate generally rectangular opposed side surfaces 12, 13 and a pair of generally rectangular opposed end surfaces 14, 15 positioned perpendicularly therebetween. A large generally rectangular and flat bottom surface 16 sealingly engages the bottom edges of the respective side surfaces 12–15 to define a liquid containing tank. The height of each of the side surfaces 12–15 is small in relation to its respective length, thus making tank 11 very shallow. In this embodiment, opposed horizontal flanges 17, 20 extend outwardly of the top edges of elongate sides 12, 13, respectively. One of a pair of parallel vertically extending rails 17*a*, 20*a*, is mounted centrally along the length of each flange 17, 20, respectively. While the tank 11 is preferably made of dielectric material such as wood, plastic, or the like, it can be made of a stronger electrically conductive material, such as steel or metal. However, in such a case, it is preferred that the interior of the tank 11 be coated with a dielectric material.

A pair of U-shape conductive metal straps 21—21 extend across the interior of tank 11 in spaced relation to each other. Straps 21—21 follow the contour of the tank interior and include a flat elongate central bight portion 22 extending across the width of the tank wall bottom surface 16. Short vertical side members 23, 24 on each strap 21 extend upwardly from each of the ends of central portion 22 thereof and are preferably positioned contiguous with the interior surfaces of sidewalls 12, 13, respectively. The upper distal ends of strap side members 23, 24 extends above the top of sidewalls 12, 13, respectively, an amount sufficient to attach an electrical connector, alligator clip 18, or the like thereto to provide a source of positive direct charge electrical current to each strap.

An important aspect of the invention is a movable wire mesh electrode, generally indicated at 25, which extends across the top of tank 11 from horizontal flange 17 to horizontal flange 20 and which, in this embodiment, is mounted on a plurality of rollers 26—26, 26*a*—26*a*, which roll upon the rails 17*a*, 20*a*, respectively, from one end of tank 11 to the other. Movable electrode 25 includes a downwardly stepped generally rectangular frame 27 which, in this embodiment, has a conductive wire mesh screen 30 extending across the bottom portion thereof. One of a plurality of inverted L-shape arm members 31—31, 32—32, extends upwardly from each corner of the rectangular frame 27 thus providing a means for mounting each wheel 26, 26*a* on the respective tank frame rail 17*a*, 20*a*. The wire mesh electrode is movable over the entire length of the tank 11 in a spatially related position above the conductive strap center portion 22 and below the top edge of the tank sidewalls. While a wire mesh electrode is utilized in the preferred embodiment, it will be noted that other shapes of conductive materials can also be utilized within the scope of the invention. However, a foraminous electrode is preferred as it allows gaseous bubbles created during polishing to escape by passing through the holes in the electrode. Also, the rising bubbles create an upward and outward fluid flow which aids the polishing process. Providing a means of escape for the bubbles further aids the polishing process. Another preferred embodiment may include a square or other tubular member with holes through the sidewalls thereof (not shown) through which electrolytic bath may be pumped to aid gas bubble removal.

The polishing apparatus 10 is a preferred apparatus for polishing the large flat surfaces of metal sheets or plates, such as shown at 33. The polishing apparatus 10 is capable of electro-polishing one side at a time of any large plate or sheet positioned horizontally in tank 11 by the procedure described hereinbelow. The sheet or plate 33 is positioned horizontally in tank 11 such that it contacts the conductive straps 21—21, which stretch across the bottom of the tank. The tank is then filled with a liquid bath or electrolyte to a level above the bottom of movable electrode 25. The electrode 25 is positioned on rails 17*a*, 20*a*, and is negatively charged with direct current by means of a connector, alligator clip 19, or the like attaching a conductor thereto. Electrode 25 acts as a cathode, and affects an electro-polishing of a strip on the surface of plate 33 immediately below and adjacent the wire mesh screen 30 thereof. When the strip of plate 33 is sufficiently polished, electrode 25 may be moved, continuously or in discreet increments, along the length of plate 33 until the entire top surface thereof is electro-polished as desired. With proper respect to the electrically charged portions of apparatus 10, or more preferably, disconnecting the charging conductors, the plate 33 may be inverted, if desired, and the opposing surface thereof may be electro-polished in like manner to the first surface thereof. It should be noted that the use of a minimal amount of polishing bath together with a cathode which is smaller in surface area than the surface to be electro-polished minimizes the capacity of the conventional current producing machinery (not shown) needed to affect the polishing operation. If the cathode were the size of the area to be electro-polished, and a large tank of electrolytic bath were utilized, the amperage required to affect polishing would be enormous. The method and apparatus disclosed herein reduce the amperage requirement to a practical level.

It can be understood that modifications of the apparatus 10 may be made within the scope of the invention. For example, the movable electrode rollers and tank rails my be replaced with a slidable arrangement, such as with arms 32 resting on the top of sidewalls 12 and 13. Also, the conductive straps 21 may be replaced by conductive rollers, casters, or the like which facilitate insertion and removal of metal sheet or plate 33 into the tank 11 while providing a source of positive charge to the object to be electro-polished.

Referring to FIG. 2*a*, a modification of apparatus 10 is shown to include a dielectric strip 38 which depends from the trailing edge of electrode 25 to end an adjustable and usually a short distance from the top surface 33*a* of the object 33 to be electro-polished. In this embodiment, strip 28 is L-shape. However, other shapes can be utilized within the scope of the invention. During electro-polishing, the ungrounded cathode 25 radiates current through the electrolytic bath. As the distance through the bath from the object to the cathode becomes greater, the current usable for electro-polishing that object becomes lower. At low current densities, surface pitting may occur on the object to be polished. Therefore, in certain instances, after the electrode 25 passes directly over the object 33 and the best degree of polished surface is obtained, it may be desirable to shield that polished surface thereafter from low levels of current. Further, it may be desirable to place another such a shield (not shown) at the leading edge of the cathode if it is desired that an edge of a polished surface portion on a sheet extend across the width thereof. Also, if surface pits develop as the cathode approaches, and if those pits are not removed when the cathode is directly overhead, a leading edge shield may be necessary to obtain a superior finish. These shields also promote solution or bath movement which is desirable for the reasons given above.

Referring to FIG. 3, the polishing tank 11 has been modified with the addition of curved top rail extensions 40-41 which attach to the horizontal flanges 17, 20, respectively, of the first embodiment shown in FIGS. 1 and 2. Each curved rail piece 40, 41 includes a bifurcated bottom portion adapted to matingly engage the rail of the respective horizontal flange upon which it is mounted. The top surfaces 42, 43 of curved rail extensions 40, 41, respectively, are also adapted to accept the wheels of movable electrode 25 in a manner similar to that shown with the first embodiment. The contoured additional rail pieces provide for positioning the movable electrode 25 in equal spatial relation with the curved surface of metal object 44 as the electrode 25 moves across the top of the metal object 44 in a manner similar to that shown and described with FIGS. 1 and 2. It should be noted that the level of electrolytic bath in tank 11 should be sufficient to cover the wire mesh 30 of movable electrode 25 when the electrode is in its highest position along the rail extensions. Also, it can be understood that the shape or contours of the rail extension may be changed to fit the contour of the desired surface of the object to be electro-polished.

The polishing apparatus 10 including the rail extensions 40, 41 is a preferred apparatus for polishing substantially flat or slightly curved pieces of sheet or plate metal, and is particularly adapted for polishing such metal objects in large quantities. However, it should be noted that the rail extensions 40, 41, may be made inexpensively of wood, plastic, or the like to custom fit the tank 11 for any particular custom polishing operation.

Referring to FIGS. 4 and 5, an object which is too large to be immersed in tank 11, in this instance, a large multiple curved metal plate structure 50 including a front curved portion 51 on which a highly polished surface is desired, is fitted with a liquid containing enclosure, generally indicated at 52, which surrounds and extends upwardly of the curved surface 51 to be polished. Enclosure 52 is preferably made of dielectric sheet material, such as wood, plastic, or the like. In this embodiment, enclosure 52 includes an elongate front member 53 positioned vertically along the leading edge of the surface 51 to be electro-polished. Two opposing side members 54, 55 are joined to front member 53 at the respective ends thereof and are positioned contiguous with the side edges of metal object 50. Enclosure 52 is completed by positioning a thin strip 56 of dielectric material between the side members 54, 55 and along the trailing edge of the surface 51 to be polished. It can be noted that if the remaining portion of the top surface of metal object 50 were to be electro-polished, another strip (not shown) similar to strip 56 could be positioned along the trailing edge of the metal object between side members 54, 55. A temporary sealing means (not shown) is utilized to provide a watertight juncture between the edges of the metal object 50 and the members of enclosure 52.

With a shallow enclosure thus formed as shown in FIG. 4, a wire mesh electrode, generally indicated at 60 in FIG. 5, may be positioned across the enclosure 52 so as to depend from front enclosure member 53 and opposed thin strip 56 and be positioned in spaced relation to the curved surface 51 to be electro-polished. While the movable electrode 25 of the embodiment shown in FIGS. 1-3 includes a plurality of rollers which ride on rails defining the top edge of the elongate sides of tank 11, the movable electrode 60 simply includes a generally rectangular frame 61 having a plurality of upwardly and outwardly extending end tabs 62—62, 63—63, which extend from the corners of the frame so as to be movably slidably retained on the top surfaces of the opposing enclosure side members. As in the first embodiment, the movable electrode 60 includes a rectangular wire mesh screen 64 positioned in the space defined by the rectangular frame 61. Since the surface 51 to be polished is curved, the movable electrode 60 is also curved along its length so as to provide equidistant spacing between the electrode 60 and the curved object surface. The equidistant spacing between the electrode and the object provides for uniformity of the polished finish across the width of the surface 51.

In order to electro-polish the curved surface 51 on metal object 50, a liquid bath is poured into the enclosure defined by the liquid containing dielectric side members 52 and the surface 51. The movable electrode 60 is positioned over the surface 51 such that it depends from the top of the container side members 53, 56. A sufficient amount of electrolytic bath is poured into the container to cover the highest portion of the movable electrode 60 from which electro-polishing action is desired. As in the first embodiment, the object 50 to be electro-polished is given a positive direct current electric charge by attaching a charged conductor 58 thereto, and the electrode 60 is made into a cathode by being negatively electrically charged, by means of a like charged connector 59 attached thereto by an electrical connection such as alligator clips or the like.

With the apparatus thus electrically charged, a strip of the curved metal surface 51 directly beneath the electrode 60 and slightly to the sides thereof is electro-polished over a period of time. When the desired finish of the curved surface is obtained, the electrode 60 is moved sideways along the length of the side members 53, 56, either in discreet increments or in a continuous movement therealong, until the entire curved surface 51 is electro-polished to the desired finish. It should be noted that if it were desired that the remainder of the top surface of metal object 50 be electro-polished, another electrode similar to movable electrode 60, but contoured to fit the curvature of the remaining surface would be utilized along with a bath poured in that portion of the metal object defined by the metal surface and the dielectric enclosure positioned therearound. Electro-polishing of the remaining portion of the top surface of object 50 would be identical with that of curved surface 51.

Referring to FIG. 6, a modification of the tank and movable cathode shown in FIGS. 1-3 is generally indicated at 70. Polishing apparatus 70 was engineered to electro-polish relatively thin elongate objects, such as the wedge-shape object 71 shown therein. Tank 70 is defined by the combination of a thin elongate bottom surface 72; elongate, relatively deep opposed side surfaces 73, 74; and opposed deep and thin end surface 75 (one shown). An outwardly extending flange or ridge 76 extends completely around the upper edges of the side members of tank 70. The thickness T of tank 70 is small in relation to its height H and length, thereby reducing the total amount of liquid bath necessary to cover the object 71 to be electro-polished. With the accessibility of the top edge of wedge-shape object 71 to any person operating the polishing apparatus, it may be desirable to attach a positive electrode 68 directly to the object rather than to mount electrically conductive straps in the tank sidewalls, as in the first embodiment.

As in the previous embodiments, a movable electrode, generally indicated at 77, is positioned across the top of tank 70 between opposing portions of the lip or flange 76 above opposing sidewalls 73 and 74. However, in this embodiment, the movable electrode 77 is a W-shape space frame 80 including an inverted V-shape active portion with a wire mesh screen 81 mounted thereon between the opposing frame rails, and a plurality of elongate inverted L-shape arm members 80 extending upwardly from the bottom ends of the active portion of frame 78. When the central inverted V-shape active portion of the moving electrode 77 is positioned over an object 71 which is properly mounted in tank 70, an equally spaced relation is presented between the electrode active portion and the opposed wedge surfaces to be electro-polished.

In operation, the object 71 is securely and stably positioned in the approximate center of tank 70, the traveling electrode 77 is positioned across the tank 70 such that the active wire mesh screen 79 is equally spaced from opposing surfaces of the object 71, and a liquid bath is inserted or poured in the tank 70 until the topmost portion of the wire mesh screen is covered thereby. The object 71 is charged with a positive charge of direct current by clamping or otherwise attaching a charged conductor 68 thereto. The movable electrode 77 is negatively charged by another conductor having an alligator clip 69, or the like at one end thereof for securing same to the electrode. Electro-polishing is conducted in the same manner as disclosed with the previous embodiments by sliding the movable electrode 77 fron one end of the object 71 to the other end thereof, continuously or in discreet increments, as the object surface under the electrode reaches a desired finish.

Referring to FIG. 7, a modification of the type of liquid containing enclosure described in connection with FIGS. 4 and 5 is generally indicated at 82. The enclosure forms a portion of the entire polishing apparatus, generally indicated at 81. Enclosure 82 is mounted upon and to some extent around a large elongate metal object 84 (shown in cross-section only) which includes an elongate flat horizontal surface 85 and an adjacent elongate flat vertical surface 86 which are to be electro-polished simultaneously. Polishing apparatus 81 includes, in this embodiment, a shallow elongate side plate 87 positioned to extend upwardly from along one edge **85*a* of the horizontal surface 85. A thin partial bottom surface member 90 is positioned to extend outwardly from one edge 86*a* of the bottom of vertical surface 86, and a relatively high elongate opposing side surface 91 extends upwardly from the outer edge 90*a* of bottom wall member 90. As with the previous embodiments, opposing end wall members 92 (only one shown) enclose the remaining edges of the surfaces 85, 86 thus defining a liquid bath containing structure with horizontal surface 85 and vertical surface 86 forming portions thereof. The polishing apparatus 81 further includes a movable electrode generally indicated at 93, forming an inverted L-shape generally rectangularly sided frame 94 having a wire mesh screen 95 mounted thereon defining an active portion thereof which operates similarly to the previously described movable electrodes. Also, the four corners of the upper horizontal rectangular portion of the movable electrode each include a hook or a hanging tab 96—96 (two shown) which extend upwardly thereof and support the movable electrode in depending fashion from the upper surfaces of the sidewall members 87, 91, respectively. As in all of the previous embodiments, cathode 93** is ungrounded when it is being utilized.

In operation, as with the previous embodiments, the enclosure is filled with a liquid bath to the height of the highest operating portion of the movable electrode 93. The object 84 to be electro-polished is given a direct current positive charge by attaching a suitable conductor 94 thereto, and the movable electrode is given a direct current negative charge by means of a conductor fastened by an alligator clip 98 or the like. During the electro-polishing operation, the areas of surfaces 85 and 86 directly under or closely adjacent to the inverted L-shape movable electrode 93 are electro-polished, and as the electro-polishing reaches the desired finish, the electrode is moved along the opposing sidewall members 87, 91 either in discreet increments or continuously, until the entire horizontal and vertical surfaces 85, 86 are electro-polished.

It will be understood that while four particular embodiments of the polishing apparatus and method have been shown and described, it will be obvious to those skilled in the art that changes and modifications may be made both in the apparatus and in the method without departing from the invention in its broader aspects. For example, the dimensions of the active portion of each electrode may be made smaller by covering portions thereof with a suitable dielectric material, such as electric tape. Therefore, the aim in the appended claims is to cover all such changes and modifications as fall within the true spirit and scope of the invention.

I claim:

1. A method of electro-polishing a surface of a metal object defining at least one flat or slightly curved area thereon wherein a liquid bath is positioned to touch the surface to be polished, and the thickness of said bath, taken generally perpendicular to said surface, is relatively small; said method comprising the steps of: framing said surface of said object to be electro-polished in an open top substantially leakproof structure, said structure being capable of supporting a shallow liquid bath above any horizontal surface to be electro-polished and capable of supporting a thin column of liquid bath touching any vertical surface to be electro-polished; depending a movable cathode from the top of said structure, said cathode including an active portion thereof which is contoured to be substantially parallel to said surface to be electro-polished and positioned in close spatial relation thereto; filling said open top structure with a liquid bath to a pre-determined level, said predetermined level allowing said liquid bath to cover said cathode active portion; charging said surface to be electro-polished with a positive electric current; charging said cathode with a negative electric current to polish at least a portion of said surface; and moving said cathode across the top of said structure until said active portion thereof is positioned in close spatial relation to an unpolished portion of said surface to be electro-polished.

2. The method called for in claim 1 wherein said step of charging said surface and said step of charging said cathode further include, respectively, the step of utilizing direct current electricity.

3. The method called for in claim 1 wherein said step of framing said surface of said object further includes the step of: fabricating liquid containing wall members around a portion of said object and attaching same thereto with said surface to be electro-polished being a boundary of said structure.

4. The method called for in claim 1 wherein said step of framing said surface further includes the step of: lowering said object into a liquid holding tank.

5. The method called for in claim 1 wherein said step of moving said cathode further includes the step of: moving said cathode continuously across said surface to be electro-polished.

6. The method called for in claim 1 wherein said step of moving said cathode further includes the step of: moving said cathode in discreet increments across said surface to be electro-polished.

7. The method called for in claim 1 wherein said step of moving said cathode further includes the step of: shielding an edge of said cathode with a dielectric material to prevent low current density pitting of said surface on said object.

8. Apparatus for electro-polishing a large flat or slightly curved surface of a metal object comprising: an open top substantially leakproof structure defining a hollow interior having a pair of opposed parallel elongate rails at the top thereof; a movable cathode mounted on said pair of rails in sliding relation there along and extending across said structure between said rails, said cathode including an active portion having a pre-determined shape across said rails, said predetermined shape providing an active portion surface substantially parallel to any surface to be electro-polished and positioned in close spatial relation thereto, and the length of said active portion along said rails being substantially less than the length of said rails; and electric current producing means for providing a negatively charged current to said cathode and a positively charged current to said metal object as an anode to be polished.

9. The apparatus called for in claim 8 wherein said electric current is direct current.

10. The apparatus called for in claim 8 wherein said cathode includes a generally rectangular frame having a wire mesh screen positioned thereacross.

11. The apparatus called for in claim 8 wherein said cathode includes apertures therein.

12. The apparatus called for in claim 8 wherein said structure is made at least partially of dielectric material.

13. The apparatus called for in claim 8 wherein said open top structure includes said metal object with said surface to be electro-polished being a portion of an interior boundary of said structure.

14. The apparatus called for in claim 8 wherein said open top structure includes a liquid holding tank adapted for receiving said metal object through the open top thereof.

15. The apparatus called for in claim 8 wherein the area defining the active portion of said cathode is substantially less than the area of said object to be electro-polished.

16. The apparatus called for in claim 8 wherein said cathode includes a dielectric shield depending from at least one of a leading and trailing edge of same for preventing low current density pitting in said surface to be polished.

17. The apparatus called for in claim 8 wherein said apparatus is adapted to electro-polish curved surfaces and said open top structure top rails are curved in a predetermined shape, said predetermined shape being similar to and positioned in alignment with any surface to be electro-polished for providing equidistant spacing between said cathode and said surface to be electro-polished as said cathode is moved along said rails.

* * * * *